United States Patent [19]

Hartman et al.

[11] Patent Number: 4,503,911

[45] Date of Patent: Mar. 12, 1985

[54] THERMAL RECOVERY METHOD FOR OPTIMUM IN-SITU VISBREAKING OF HEAVY OIL

[75] Inventors: Kathy J. Hartman, Arlington; Winston R. Shu, Dallas, both of Tex.

[73] Assignee: Mobil Oil Corporation, New York, N.Y.

[21] Appl. No.: 504,998

[22] Filed: Jun. 16, 1983

Related U.S. Application Data

[63] Continuation-in-part of Ser. No. 331,424, Dec. 16, 1981, abandoned.

[51] Int. Cl.[3] ..... E21B 43/24

[52] U.S. Cl. ..... 166/272; 166/303

[58] Field of Search ..... 166/303, 272

[56] References Cited

U.S. PATENT DOCUMENTS

| | | | |
|---|---|---|---|
| 3,129,757 | 4/1964 | Sharp | 166/272 X |
| 3,330,353 | 7/1967 | Flohr | 166/303 X |
| 3,349,849 | 10/1967 | Clossman | 166/303 X |
| 3,439,741 | 4/1969 | Parker | 166/272 |
| 3,460,621 | 8/1969 | Gum et al. | 166/303 X |
| 3,782,470 | 1/1974 | West et al. | 166/303 |
| 4,262,745 | 4/1981 | Stewart | 166/303 X |

*Primary Examiner*—Stephen J. Novosad
*Assistant Examiner*—Michael Starinsky
*Attorney, Agent, or Firm*—Alexander J. McKillop; Michael G. Gilman; Malcolm D. Keen

[57] ABSTRACT

A method for the recovery of oil from a subterranean, viscous oil-containing formation by injecting a predetermined amount of steam into the formation via a well completed in the middle portion of the oil-containing formation for a distance between 40 to 60 percent of the vertical thickness of the oil-containing formation, terminating injection of steam and producing fluids including oil through the same well used for the injection of steam. The steps of injecting steam and producing oil can be repeated for a plurality of cycles. Injecting steam through a selected completion interval in the middle of the formation induces maximum visbreaking of the viscous oil within the formation by controlling heat losses to the over and under strata.

5 Claims, 2 Drawing Figures

THERMAL RECOVERY METHOD FOR OPTIMUM IN-SITU VISBREAKING OF HEAVY OIL

CROSS-REFERENCE RELATED APPLICATION

This application is a continuation-in-part of co-pending application Ser. No. 331,424, filed Dec. 16, 1981, now abandoned.

FIELD AND BACKGROUND OF THE INVENTION

1. Field of the Invention

This invention pertains to an improved cyclic steam stimulation method for the recovery of oil from subterranean viscous oil-containing formations. More particularly, it relates to a cyclic steam stimulation method for the recovery of oil from subterranean viscous oil-containing formations utilizing a selected completion interval to induce maximum visbreaking of the viscous oil within the formation.

2. Background of the Invention

Steam has been used in many different methods for the recovery of oil from subterranean, viscous oil-containing formations. The two most basic processes using steam for the recovery of oil includes a "steam drive" process and "huff and puff" steam process. Steam drive involves injecting steam through an injection well into a formation. Upon entering the formation, the heat transferred to the formation by the steam lowers the viscosity of the formation oil, thereby improving its mobility. In addition, the continued injection of the steam provides the drive to displace the oil toward a production well from which it is produced. Huff and puff involves injecting steam into a formation through an injection well, stopping the injection of steam, permitting the formation to soak and then back producing oil through the original injection well.

Heavy or viscous oils go through significant visbreaking upon heating at temperatures normally above 400° F. Such reduction in viscosity significantly enhances recovery during a thermal operation and improves the quality of heavy oils.

In copending application Ser. No. 320,236, filed Nov. 12, 1981 to W. R. Shu et al, now abandoned, there is disclosed a method to induce in-situ visbreaking of heavy oils by injecting a hot heat-transfer fluid such as steam in a cyclic operation. In the later method, it was found that visbreaking was greater in a formation with no underlying water zone and with a large completion interval during cyclic steam stimulation.

We have found that the cyclic steam stimulation method can be improved to induce maximum visbreaking of viscous oils in-situ for a formation with or without a significant underlying water layer if the steam is injected through a selected completion interval to control heat losses to the over and under strata.

SUMMARY OF THE INVENTION

The invention is a method for recovering oil from a subterranean, viscous oil-containing formation employing a cyclic steam stimulation process comprising injecting the steam through a selected completion interval so as to control the heat losses to the over and under strata and thereby induce maximum visbreaking of the viscous oil in-situ for formations with or without significant underlying water layers. An injection well is provided for injecting steam into the formation and fluid communication is established between the well and the oil-containing formation above and below the center of the formation for a distance from about 20 to about 30 percent of the vertical thickness of the oil-containing formation thereby resulting in a completion interval between 40 to 60% of the oil-containing formation. For oil-containing formations with underlying water, the thickness of the oil-containing formation is that distance from the oil-water contact to the top of the oil-containing formation adjacent the overburden. Steam is injected into the formation via the injection well for a predetermined period of time so as to lower the viscosity of the viscous oil within the formation. After a predetermined amount of steam has been injected into the formation through the selected completion interval, injection of steam is terminated and the injection well is turned around and fluids including oil are produced from the formation via the injection well until oil production is unfavorable. After oil production is unfavorable, steam injection may again be applied followed by another period of production. The steps of injecting steam and producing the formation may be repeated for a plurality of cycles.

DESCRIPTION OF THE PREFERRED EMBODIMENTS

Basically, the process of our invention is a cyclic steam stimulation process for the recovery of oil from a subterranean, viscous oil-containing formation wherein the steam is injected through a selected completion interval to control the heat losses to the over and under strata thereby inducing maximum visbreaking of oil in the formation with or without significant underlying wtaer. For an oil-containing formation without underlying water, the steam is injected at the center of the oil-containing formation and for formations with underlying water, the steam is injected at a point midway between the oil-water contact and the top of the oil-containing formation. The completion interval is between 40 to 60 percent of the vertical thickness of the oil-containing formation, excluding the water layer.

Figure 1:
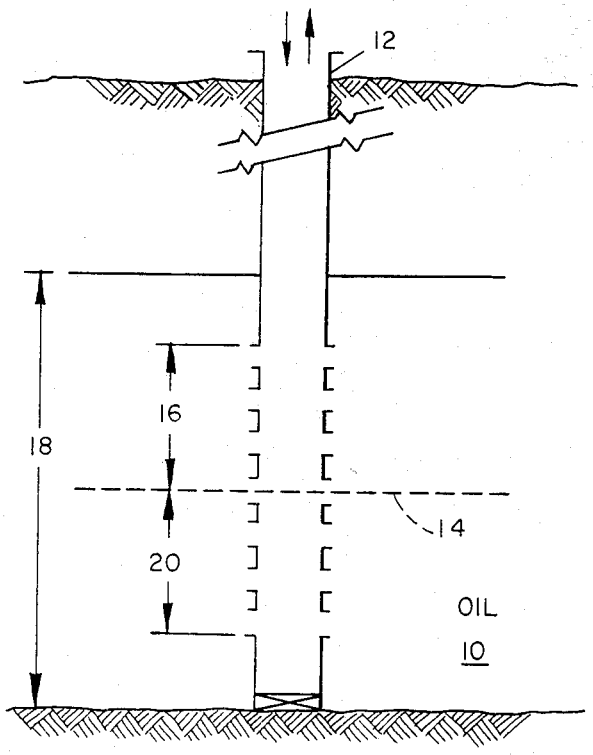
FIG. 1 illustrates in cross-sectional view a subterranean viscous oil-containing formation to which the process of our invention is applied showing the method of completing the well penetrating the formation.

The process may be more readily understood by referring to the attached FIG. 1 in which an oil-containing formation 10 is penetrated by an injection well 12. Injection well 12 serves as a thermal fluid injection well in which perforations are formed or fluid communication is otherwise established between well 12 and the oil-containing formation 10 in the middle portion of the oil-containing formation for distances between 40% and 60% of the thickness of the oil-containing formation. More specifically, the perforations are formed above the center 14 of the formation for a distance designated as 16 in FIG. 1 from about 20% to 30% of the vertical thickness 18 of the oil-containing formation and below the center of the formation for a distance designated as 20 from about 20 to 30 percent of the vertical thickness of the oil-containing formation. This constitues a completion interval in the range of 40 to 60% of the vertical thickness of the oil-containing formation 10 located in the center of the oil-containing formation which is the optimum interval to reduce heat losses to the over and under strata of the formation. Too large a completion level promotes heat losses to the over and under strata while too small a completion interval limits the channel for fluid flow.

For oil-containing formations with an underlying oil-water saturated interval, the vertical thickness of the oil-containing formation 10 as illustrated in FIG. 1 is the distance from the oil-water contact to the top of the oil-containing formation adjacent the overburden.

Steam is injected into well 12 for a predetermined period of time at a pressure that is less than the overburden pressure, usually within the range of about 500 to about 2000 psig, and at a temperature within the range from 400° F. to 700° F., preferably within the range of 500° F. to 650° F. Steam may be saturated or superheated. Generally, in most field applications the steam will be saturated with a quality from about 60% to about 95%.

The volume of steam injected will vary depending on the thickness of the oil-containing formation, the porosity of the formation and the boiler capacity. In order to obtain optimum visbreaking of the in place oil, the amount of steam injected into the formation is about 20 to 300 barrels of steam per foot of pay zone per cycle, and preferably 80 barrels of steam per foot of pay zone per cycle. The injection period varies between 10 and 100 days. Because of the many variables involved, treatment time is often determined through experience in a particular field.

After a predetermined amount of steam has been injected into the formation 10 via the injection well 12 in fluid communication with the middle 40 to 60 percent of the oil-containing formation, injection of steam is terminated and fluids including oil reduced in viscosity are immediately produced from the formation via the injection well. Production is continued until the production of oil in the fluids being recovered reaches an undesirable low level.

The steps of injecting steam and producing the formation may be repeated periodically for a plurality of cycles in any manner that proves desirable from an economical standpoint. The time interval between applications will depend upon the rate at which the formation cools during production, which will in turn be reflected by an unfavorable production rate.

EXPERIMENTAL SECTION

Utilizing a computational model and computer program, we will demonstrate the enhanced oil recovery achieved from the application of our process.

All runs to be described more fully hereinafter were performed in a simulated viscous oil-containing formation 130 feet thick overlying a water saturated sand interval 20 feet thick with a water saturation of 0.88 and located under an overburden. The oil contained in the formation has a viscosity of 61,900 cp at 55° F. For all runs saturated steam of 70% quality at 650° F. was injected into the formation via an injection well at injection rates of approximately 1000 barrels per day for 30 days for a total volume of injected steam equal to 28,500 barrels. At the end of the 30 day steam injection period, injection of steam was terminated and the injection well turned around and produced for a period of 70 days.

In the first run, the well was perforated to provide fluid communication between the well and the oil-containing formation for a distance of 70 feet formed from a point 35 feet from the oil-water contact up to a point 75 feet below the bottom of the overburden. This perforated completion interval of 70 feet is equivalent to 54% of the thickness (130 feet) of the oil-containing formation or net pay. Heat loss for Run 1 was 2% while the visbroken oil/steam ratio was 0.101, or an equivalent visbroken oil production of 2879 barrels.

Run 2 involved the use of a completion interval of 85 feet or 65% of net pay. Heat loss was 3.2% while the visbroken oil/steam ratio was 0.09.

Run 3 utilized a completion interval of 120 feet or 92% of net pay. Heat loss was 7% and the visbroken oil/steam ratio was 0.048.

Run 4 involved the use of a completion level of 35 feet or 27% of net pay. Heat loss was 1.75% while the visbroken oil/steam ratio was 0.07.

The location of the completion interval and the interval open for all the runs is summarized in Table 1 below.

TABLE 1

| Completion Intervals: | | | | |
|---|---|---|---|---|
| Center Location, ft | | | Interval Open | |
| Run | From Top | From Oil/Water Contact | Feet | % of Net Pay (130 ft) |
| 1 | 60 | 70 | 70 | 54 |
| 2 | 52.5 | 77.5 | 85 | 65 |
| 3 | 70 | 80 | 120 | 92 |
| 4 | 77.5 | 72.5 | 35 | 27 |

Figure 2:
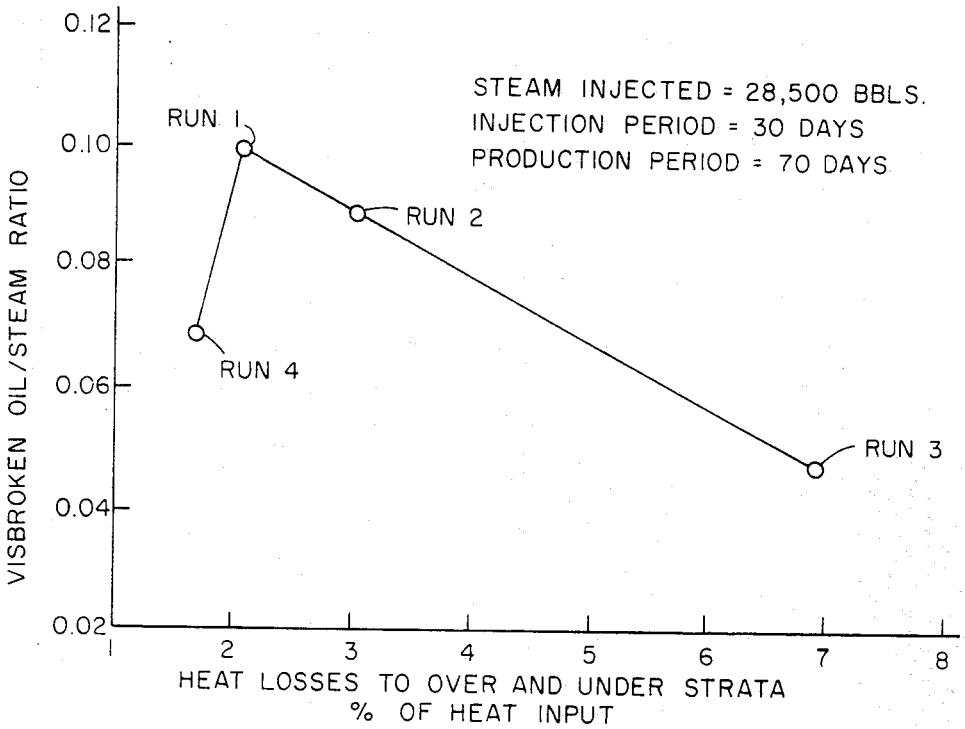
FIG. 2 illustrates the visbroken oil production versus percent heat loss to the over and under strata for four runs involving cyclic steam stimulation utilizing varying completion intervals.

FIG. 2 shows the effect of completion interval on the visbroken oil/steam ratio and percent heat loss to the over and under strata for Runs 1, 2, 3 and 4. These results show a distinct increase is visbroken oil production for a completion level of 54% (Run 1).

The foregoing experimental results amply demonstrate that optimum in-situ visbreaking of viscous oil in oil-containing formations for a cyclic steam stimulation process occur at a completion interval between 40 to 60% of the net formation thickness.

From the foregoing specification, one skilled in the art can readily ascertain the essential features of the invention and without departing from the spirit and scope thereof can adapt it to various diverse applications. It is our intention and desire that our invention be limited only by those restrictions or limitations as are contained in the claims appended immediately hereinafter below.

What is claimed is:

1. A method of recovering viscous oil from a subterranean, viscous oil-containing formation, comprising:

(a) providing an injection well in fluid communication with the middle 40 to 60 percent of the oil-containing formation;

(b) injecting 20 to 300 barrels of steam per foot of pay zone over a period of time from 10 to 100 days at a temperature within the range of 400° to 700° F. and a quality within the range of 60 to 95 percent into the oil-containing formation via said injection well to maximize visbreaking of the oil due to minimum heat losses;

(c) terminating injection of said steam and thereafter recovering fluids including oil from said formation via said injection well until the production of oil in the fluids being recovered reaches an undesirable low level.

2. The method of claim 1 wherein steps (b) and (c) are repeated for a plurality of cycles.

3. The method of claim 1 wherein the temperature of said steam is within the range of 500° to 650° F.

4. The method of claim 1 wherein the amount of steam injected is 80 barrels of steam per foot of pay zone per cycle.

5. The method of claim 1 wherein the temperature of the steam is about 650° F., the quality of the steam is about 70 percent, the steam injection period is about 30 days at a rate of about 1000 barrels per day, and the oil-containing formation thickness is about 130 feet.

* * * * *